US011802364B2

(12) United States Patent
Kakehi et al.

(10) Patent No.: US 11,802,364 B2
(45) Date of Patent: Oct. 31, 2023

(54) CONDENSING SYSTEM FOR COMBINATION WASHER/DRYER APPLIANCE

(71) Applicant: Whirlpool Corporation, Benton Harbor, MI (US)

(72) Inventors: Sachie Kakehi, Oradell, NJ (US); Mauro Mancini, Fabriano (IT); Nicholas Vaive, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 41 days.

(21) Appl. No.: 17/691,357

(22) Filed: Mar. 10, 2022

(65) Prior Publication Data

US 2022/0333291 A1 Oct. 20, 2022

Related U.S. Application Data

(60) Provisional application No. 63/175,813, filed on Apr. 16, 2021.

(51) Int. Cl.

| | |
|---|---|
| ***D06F 39/08*** | (2006.01) |
| ***D06F 34/26*** | (2020.01) |
| ***D06F 39/00*** | (2020.01) |
| ***D06F 39/04*** | (2006.01) |

(52) U.S. Cl.

CPC ..... *D06F 39/085* (2013.01); *D06F 34/26* (2020.02); *D06F 39/006* (2013.01); *D06F 39/04* (2013.01)

(58) Field of Classification Search

CPC ..... D06F 33/34; D06F 33/46; D06F 33/54; D06F 33/63; D06F 33/72; D06F 34/26; D06F 58/24; D06F 39/006; D06F 39/08; D06F 39/083; D06F 39/085

See application file for complete search history.

(56) References Cited

U.S. PATENT DOCUMENTS

| | | | |
|---|---|---|---|
| 9,389,018 B2 | 7/2016 | Pademo et al. | |
| 2010/0263226 A1 | 10/2010 | Balerdi Azpilicueta et al. | |
| 2017/0233941 A1* | 8/2017 | Lee | D06F 58/24 34/471 |

FOREIGN PATENT DOCUMENTS

| | | |
|---|---|---|
| CN | 101701404 A | 5/2010 |
| CN | 111021009 A | 4/2020 |
| DE | 3618920 A1 | 12/1987 |
| DE | 102005056942 A1 | 5/2007 |
| EP | 2372012 B1 | 8/2016 |
| EP | 3192912 A1 | 7/2017 |

(Continued)

*Primary Examiner* — David G Cormier

(74) *Attorney, Agent, or Firm* — Harness, Dickey & Pierce PLC

(57) ABSTRACT

A fluid condensing system for a combination washer/dryer appliance includes a metal condenser coil positioned within a condenser. Water liquid pulses through the metal condenser coil for maintaining the metal condenser coil at a cold temperature as water vapor in the hot exhaust air from the combination washer/dryer appliance condenses on the surface of the condenser coil. A common sump collects the water condensate from the condenser, the cooling fluid exiting the condenser coil, and wash water from the combination washer/dryer appliance. The water condensate, cooling fluid, and wash water is reclaimed and recycled through both a condenser coil recirculation loop and a wash water dispenser system.

20 Claims, 3 Drawing Sheets

(56) References Cited

FOREIGN PATENT DOCUMENTS

| | | | |
|---|---|---|---|
| FR | 2249206 | A1 | 5/1975 |
| GB | 1449308 | A | 9/1976 |
| GB | 1510528 | A | 5/1978 |
| KR | 20060106071 | A | 10/2006 |
| WO | 2011128241 | A1 | 10/2011 |
| WO | 2019011227 | A1 | 1/2019 |
| WO | 2020015511 | A1 | 1/2020 |

* cited by examiner

CONDENSING SYSTEM FOR COMBINATION WASHER/DRYER APPLIANCE

CROSS-REFERENCE TO RELATED APPLICATIONS

This application claims the benefit of U.S. Provisional Application No. 63/175,813, filed on Apr. 16, 2021. The entire disclosure of the above application is incorporated herein by reference.

FIELD

The present disclosure relates to laundry appliances such as combination washer/dryer appliances and, more particularly, to a condensing system for combination washer/dryer appliances that reclaims and recirculates water condensate.

BACKGROUND

The statements in this section merely provide background information related to the present disclosure and may not constitute prior art.

Laundry appliances/laundry machines are prolific in both residential and commercial settings. Traditionally, separate washer and dryer machines have been used in tandem to clean and dry laundry. However, there is a growing market for combination washer/dryer appliances where a single machine performs both the washing and drying functions, thereby eliminating the need for two separate machines. There are a number of different names used to describe combination washer/dryer appliances, including without limitation, "washer/dryer combos" and "all-in-one washer/dryers." While these units save space compared to separate washer and dryer machines, combining the washing and drying functions into a single appliance presents a number of engineering challenges.

In combination washer/dryer appliances, the drying cycle can last a long period of time. The main reason for the length of time is that it can take more time to remove water vapor from the drying air and thus the load of laundry within the combination washer/dryer appliance when residual moisture exists within the appliance at the completion of the washing cycle and the beginning of the drying cycle. To address this problem, some combination washer/dryer appliances utilize a condenser to remove water vapor from the drying air during the drying cycle.

Various types of condenser solutions exist to overcome the drying time issue. One such solution is using the main wash cold water valve to spray pulses of cold water for less than one second every 20 seconds across the front of the drum. This solution produces minimal condensing and also lowers the temperature of the tub, which reduces drying performance. Another condenser solution uses the main wash cold water valve to spray pulses of water for approximately 10 seconds every minute or 20 seconds every two minutes, for example, through a distribution nozzle at the top of a condenser. This sprays water down the length of the condenser and tub and into a drain. These designs utilize fluid-to-fluid heat transfer between cold water and the drying air stream, but residence time is low, which results in poor condensation. Another type of condenser solution uses a hole formed on the side of the condenser to pull in fresh air, but this produces an undesirable venting effect. While these designs do make some in-roads to the drying time problem, drying can still take anywhere from 167-370 minutes to dry a 6 kg cotton clothes load.

It is an object of the present disclosure to overcome the deficiencies discussed above.

SUMMARY

This section provides a general summary of the disclosure and is not a comprehensive disclosure of its full scope or all of its features.

According to one aspect of the present disclosure a condensing system for a laundry appliance is provided. The condensing system includes an exhaust air recirculation loop, a condenser, and a condenser coil recirculation loop. The exhaust air recirculation loop includes an air inlet conduit and an air outlet conduit. The air inlet conduit extends between an exhaust air inlet port and a condenser inlet port. The air outlet conduit extends between a condenser outlet port and a drying air return port. The condenser is connected to and is arranged in fluid communication with the condenser inlet port of the air inlet conduit and the condenser outlet port of the air outlet conduit. The condenser further includes a water condensate outlet and a condenser drain line that is connected to the water condensate outlet. The water condensate outlet is positioned to drain water condensate collecting in the condenser.

A condenser coil is positioned within the condenser. The condenser coil includes a fluid inlet and a fluid outlet and the condenser coil recirculation loop includes a fluid supply line that is connected to the fluid inlet of the condenser coil and a fluid return line that is connected to the fluid outlet of the condenser coil.

A common sump is arranged in fluid communication with both the fluid return line of the condenser coil recirculation loop and the condenser drain line such that the common sump is configured to collect fluid exiting the condenser coil and the water condensate draining from the condenser. The common sump is also arranged in fluid communication with both the fluid supply line of the condenser coil recirculation loop and a fresh water inlet of the laundry appliance such that the common sump is configured to supply the fluid and water condensate returning to the common sump to both the condenser coil for cooling enhanced condensation and the fresh water inlet for use in a washing cycle of the laundry appliance. The fluid and water condensate returning to the common sump is supplied to the fresh water inlet where it combines with fresh water before being used in the washing cycle of the laundry appliance.

In accordance with another aspect of the present disclosure, the condensing system further includes a fluid transfer conduit that is connected to and extends between the common sump and the fresh water inlet. In accordance with another aspect of the present disclosure, a pump, located in fluid communication with the common sump and the fluid transfer conduit, is configured to pump the fluid and water condensate out of the common sump and into the fluid transfer conduit. In accordance with another aspect of the present disclosure, the fluid supply line of the condenser coil recirculation loop is arranged in fluid communication with the pump and/or the fluid transfer conduit.

In accordance with another aspect of the present disclosure, the fresh water inlet includes at least one valve that is arranged to permit fluid flow out of the fluid transfer conduit in a first position and permit the flow of fresh water into the fluid transfer conduit in a second position. In accordance with another aspect of the present disclosure, a controller is arranged in electronic communication with the pump and/or the valve of the fresh water inlet. The controller is programmed to control the pump and/or the valve of the fresh water inlet to supply the fluid to the condenser coil in pulses to maintain the condenser coil at a cold temperature as water vapor in hot exhaust air from the air inlet conduit condenses on the condenser coil.

In accordance with another aspect of the present disclosure, the condensing system includes a fan that is positioned to direct cooling airflow over the condenser to further cool the condenser. In accordance with another aspect of the present disclosure, a temperature sensor is positioned in the air inlet conduit, adjacent to the condenser inlet port, to take temperature measurements of the hot exhaust air flowing into the condenser. In accordance with another aspect of the present disclosure, the condensing system includes a Peltier cell that is attached to the condenser. The Peltier cell has a cold side that is arranged to promote the condensation of water vapor within the condenser and a hot side that is arranged to reheat drying air exiting the condenser through the condenser outlet port.

In accordance with another aspect of the present disclosure, a combination washer/dryer appliance is provided, which includes the condensing system described above. The combination washer/dryer appliance generally includes an appliance housing, an appliance door that is pivotally mounted to the appliance housing, and a drum and tub assembly positioned inside the appliance housing. The drum and tub assembly includes a tub and a drum that is rotatably supported within the tub. A fresh water inlet is disposed within the appliance housing and is configured to be connected to a fresh water source.

The combination washer/dryer appliance further includes an exhaust air recirculation loop, a condenser, and a condenser coil recirculation loop. The exhaust air recirculation loop includes an air inlet conduit and an air outlet conduit. The air inlet conduit extends between an exhaust air inlet port and a condenser inlet port, while the air outlet conduit extends between a condenser outlet port and a drying air return port. The condenser is connected to and arranged in fluid communication with the condenser inlet port of the air inlet conduit and the condenser outlet port of the air outlet conduit. A condenser coil is positioned within the condenser and the condenser includes a water condensate outlet that is positioned to drain water condensate collecting in the condenser. A condenser drain line is connected to the water condensate outlet to carry the water condensate away from the condenser. The condenser coil includes a fluid inlet and a fluid outlet and the condenser coil recirculation loop includes a fluid supply line that is connected to the fluid inlet of the condenser coil and a fluid return line that is connected to the fluid outlet of the condenser coil.

The combination washer/dryer appliance further includes a common sump that is arranged in fluid communication with both the fluid return line of the condenser coil recirculation loop and the condenser drain line such that the common sump is configured to collect fluid exiting the condenser coil and the water condensate draining from the condenser. The common sump is also arranged in fluid communication with both the fluid supply line of the condenser coil recirculation loop and the fresh water inlet such that the common sump is configured to supply the fluid and water condensate returning to the common sump to both the condenser coil for cooling enhanced condensation and the fresh water inlet for use in a washing cycle of the combination washer/dryer appliance.

In accordance with another aspect of the present disclosure, a wash tub drain line is connected in fluid communication with and extends between the tub and the common sump. The wash tub drain line is configured to receive wash water draining from the tub and carry it to the common sump. In accordance with another aspect of the present disclosure, a wash water dispensing system is connected to the fresh water inlet. The wash water dispensing system is arranged inside the appliance housing and is configured to received fresh water from the fresh water inlet and dispense wash water into the tub. In accordance with another aspect of the present disclosure, a fluid transfer conduit is connected in fluid communication with the common sump and the wash water dispensing system. The fluid, water condensate, and wash water returning to the common sump is supplied to the wash water dispensing system for use during the washing cycle of the combination washer/dryer appliance. In accordance with another aspect of the present disclosure, a pump is located in fluid communication with the sump and the fluid transfer conduit. The pump is configured to pump the fluid, water condensate, and wash water out of the common sump and into the fluid transfer conduit. In accordance with another aspect of the present disclosure, the fluid supply line of the condenser coil recirculation loop is arranged in fluid communication with the fluid transfer conduit.

In accordance with another aspect of the present disclosure, the combination washer/dryer appliance further includes a heating unit that is disposed inside the appliance housing. The heating unit includes a heater and a dryer duct that extends from the heater to a rear wall of the drum. The dryer duct is therefore configured to blow hot drying air through perforations in the rear wall of the drum.

In accordance with another aspect of the present disclosure, the air inlet conduit and the exhaust air inlet port are arranged along a sidewall of the tub and are configured to receive hot exhaust air exiting the drum. Meanwhile, the air outlet conduit and the drying air return port are arranged along the sidewall of the tub between the air inlet conduit and a rear wall of the tub and are configured to supply drying air exiting the condenser to the drum. In accordance with another aspect of the present disclosure, a temperature sensor is positioned in the air inlet conduit to take temperature measurements of the hot exhaust air flowing through the air inlet conduit.

In accordance with another aspect of the present disclosure, the combination washer/dryer appliance further includes a Peltier cell attached to the condenser. The Peltier cell includes a cold side that is arranged to promote the condensation of water vapor within the condenser and a hot side that is arranged to reheat the drying air exiting the condenser through the condenser outlet port.

In accordance with another aspect of the present disclosure, the combination washer/dryer appliance further includes a fan mounted on the tub. The fan is positioned to direct cooling airflow over the condenser to further cool the condenser and promote the condensation of water vapor inside the condenser.

In accordance with another aspect of the present disclosure, a combination washer/dryer appliance is provided that generally includes an appliance housing, an appliance door that is pivotally mounted to the appliance housing, and a drum and tub assembly positioned inside the appliance housing. The drum and tub assembly includes a tub and a drum that is rotatably supported within the tub. A wash water dispensing system is arranged inside the appliance housing to dispense wash water into the tub.

The combination washer/dryer appliance further includes an exhaust air recirculation loop, a condensing system, and a condenser coil recirculation loop. The exhaust air recirculation loop includes an air inlet conduit and an air outlet conduit. The air inlet conduit extends between an exhaust air inlet port and a condenser inlet port, while the air outlet conduit extends between a condenser outlet port and a drying air return port. The condensing system includes a condenser that is connected to and arranged in fluid communication with the condenser inlet port of the air inlet conduit and the condenser outlet port of the air outlet conduit. A condenser coil is positioned within the condenser. The condenser coil includes a fluid inlet and a fluid outlet and the condenser coil recirculation loop includes a fluid supply line that is connected to the fluid inlet of the condenser coil and a fluid return line that is connected to the fluid outlet of the condenser coil. The condenser also has a water condensate outlet, which is positioned to drain water condensate collecting in the condenser, and a condenser drain line is connected to the water condensate outlet.

The combination washer/dryer appliance includes a common sump that is arranged in fluid communication with both the fluid return line of the condenser coil recirculation loop and the condenser drain line such that the common sump is configured to collect fluid exiting the condenser coil and the water condensate draining from the condenser.

The combination washer/dryer appliance further includes a fluid transfer conduit that is connected in fluid communication with the common sump and both the fluid supply line of the condenser coil and the wash water dispensing system such that the fluid and water condensate returning to the common sump is recirculated to both the condenser coil and the wash water dispensing system for use in a washing cycle of the combination washer/dryer appliance.

The present disclosure provides a condensation system that reduces the drying time of a combination washer/dryer appliance and has the added benefit of returning recycled and reclaimed water to the common sump to be reused in the condenser coil recirculation loop and/or the wash cycle of the combination washer/dryer appliance. Advantageously, this reduces the water usage of the combination washer/dryer appliance. Also, the present disclosure provides faster cycle times and reduced load temperature to improve care of the garments and reduce shrinkage and lint generation.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
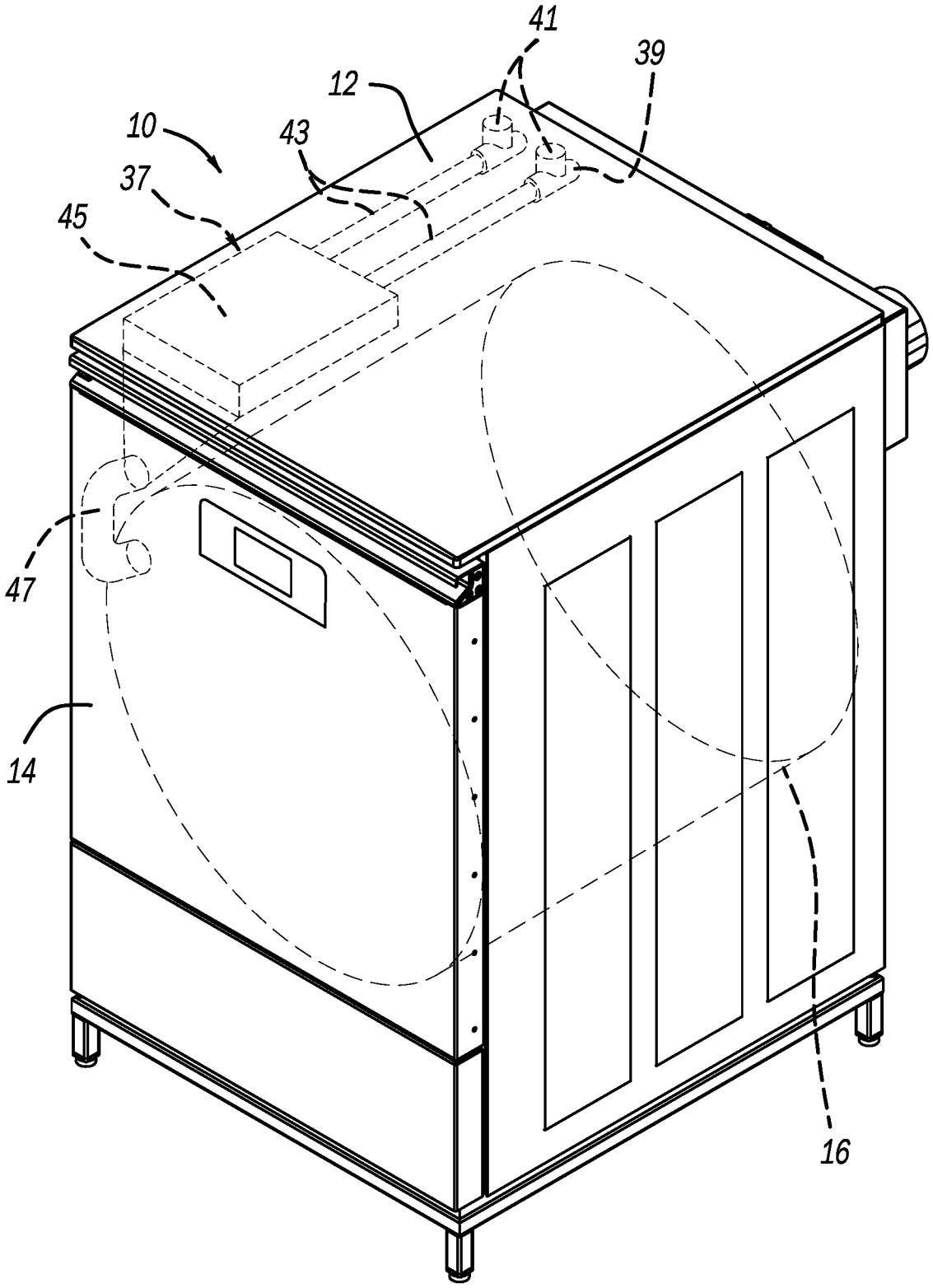
FIG. 1 is a side perspective view of an exemplary combination washer/dryer appliance that is constructed in accordance with the present disclosure.

Referring to the Figures, wherein like numerals indicate corresponding parts throughout the several views, a combination washer/dryer appliance 10 is illustrated.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

For purposes of description herein the terms "up," "down," "above," "below," "upper," "lower," "top," "bottom," "front," "rear," and derivatives thereof shall relate to the assembly as oriented in FIGS. 1-3. However, it is to be understood that the apparatus and assemblies described herein may assume various alternative orientations.

Figure 2:
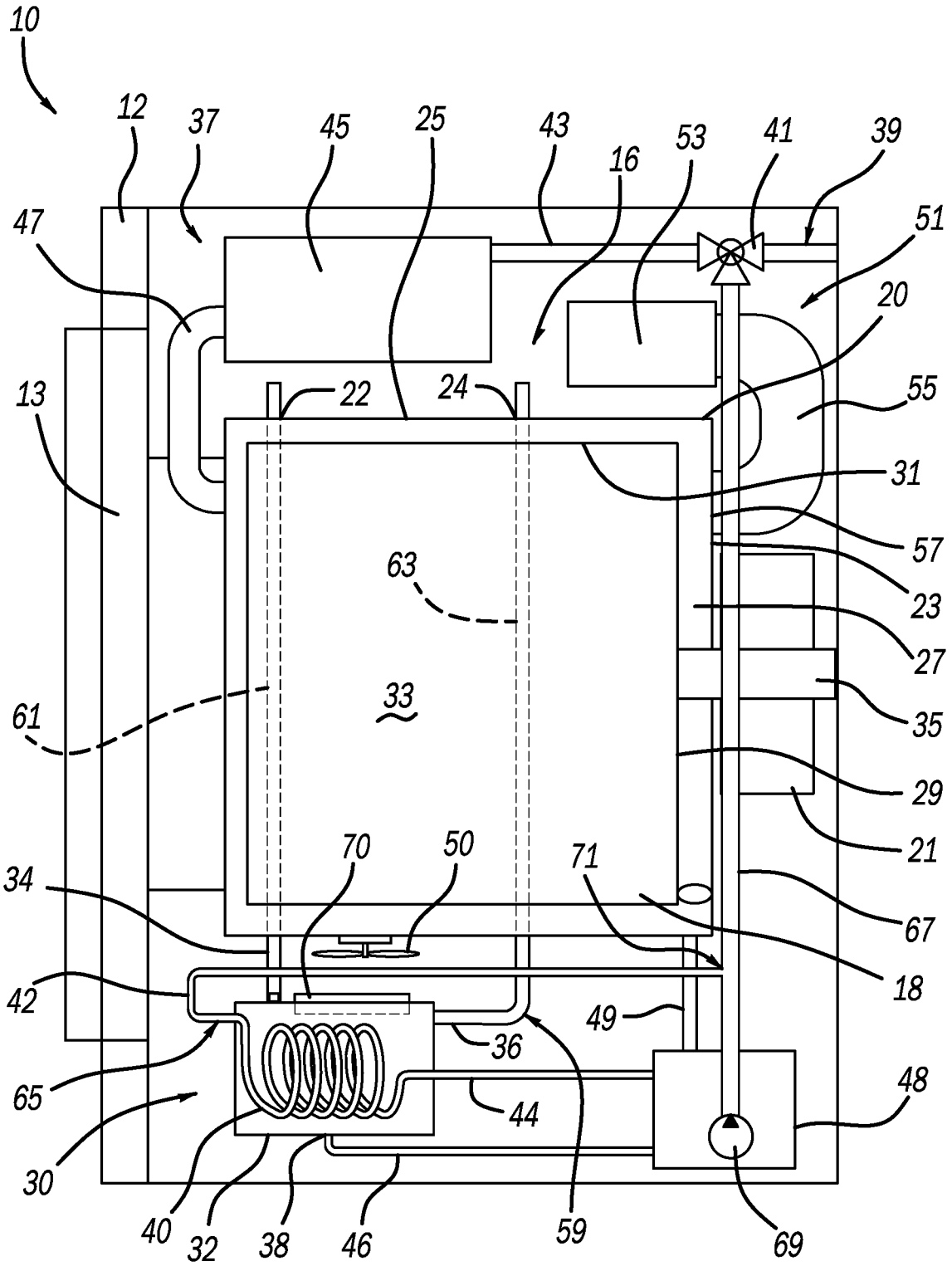
FIG. 2 is a side cross-sectional view of the exemplary washer/dryer appliance shown in FIG. 1, which illustrates an exemplary condensing system of the present disclosure.

With reference to FIGS. 1 and 2, a washer/dryer combination appliance 10 having a front-load configuration is illustrated. As explained above, the washer/dryer combination appliance 10 is a type of laundry appliance and includes an appliance housing 12 that is rectangular in shape and has a front opening 13. An appliance door 14 is pivotally connected to the appliance housing 12. The appliance door 14 swings between an open position and a closed position. In the closed position, the appliance door 14 shuts or closes the front opening 13 in the appliance housing 12. A drum and tub assembly 16 is positioned within the appliance housing 12, which may alternatively be referred to as a wash unit assembly. The drum and tub assembly 16 includes a drum 18 and a tub 20. The drum and tub assembly 16 includes a motor 21 that rotates/spins the drum 18 within the tub 20.

The tub 20 has a cylindrical shape and is mounted inside the appliance housing 12 on dynamic mounts (not shown) such that the tub 20 can shake and oscillate inside the appliance housing 12, but does not rotate itself within the appliance housing 12. The tub 20 includes a rear tub wall 23 and a tub sidewall 25 that extends longitudinally from the rear tub wall 23. The rear tub wall 23 and the tub sidewall 25 cooperate to define a tub cavity 27 inside the tub 20.

The drum 18 is positioned in the tub cavity 27 such that the drum 18 is rotatable with respect to the tub 20 about a longitudinal (i.e., substantially horizontal) axis. The drum 18 also has a cylindrical shape and includes a rear drum wall 29 and a drum sidewall 31 that extends longitudinally from the rear drum wall 29. The rear drum wall 29 and the drum sidewall 31 cooperate to define a laundry compartment 33 inside the drum 18. Access to the laundry compartment 33 inside the drum 18 is provided when the appliance door 14 is in the open position. Thus, it should be appreciated that in use, laundry (e.g., clothes, towels, and bedding) is placed inside the laundry compartment 33 where the laundry is first cleaned during a wash cycle and then dried during a drying cycle of the washer/dryer combination appliance 10.

A drive shaft 35, fixedly coupled to the rear drum wall 29, extends co-axially along the longitudinal axis and through the rear tub wall 23. The drive shaft 35 is supported by a bearing pack (not shown) mounted in the rear tub wall 23 such that the drive shaft 35 and the drum 18 rotate together as a single unit within the appliance housing 12. The motor 21 is positioned in the appliance housing 12 and is coupled to the drive shaft 35. The motor 21 drives rotation of the drive shaft 35 and the drum 18 relative to the tub 20 and the appliance housing 12 during operation of the washer/dryer combination appliance 10, such as during washing and tumbling.

The washer/dryer combination appliance 10 includes a wash water dispensing system 37 that is connected to a fresh water inlet 39 located at the rear of the appliance housing 12. The wash water dispensing system 37 is arranged inside the appliance housing 12 and is configured to received fresh water from the fresh water inlet 39 and dispense wash water into the tub 20 during a wash cycle. More specifically, the wash water dispensing system 37 may include one or more water inlet valves 41, connected to the fresh water inlet 39, and one or more hot and cold water inlet lines 43 that extend from the water inlet valves 41 to a dispenser box 45. Optionally, the dispenser box 45 may include a dosing drawer for receiving doses of detergent, bleach, fabric softener, and the like. The water dispensing system 37 also includes a dispenser tube 47, which carries wash water from the dispenser box 45 to the tub 20, where the wash water is discharged. A wash tub drain line 49 is connected in fluid communication with and extends from the tub 20 to a common sump 48. The wash tub drain line 49 is thus configured to receive wash water draining from the tub 20 and carry the wash water to the common sump 48.

The washer/dryer combination appliance 10 includes a heating unit 51 disposed inside the appliance housing 12. The heating unit 51 includes a heater 53 and a heating duct 55. The heater 53 may be an electric heater or gas heater (e.g., natural gas or propane), for example, and is configured to heat the air inside the tub cavity 27 and laundry compartment 33 during drying cycles of the washer/dryer combination appliance 10. The rear tub wall 23 has at least one dryer outlet opening 57 and the heating duct 55 extends from the heater 53 to the dryer outlet opening 57 in the rear tub wall 23 to blow hot drying air into the tub cavity 27. The rear drum wall 29 has a disc shape and a plurality of perforations (not shown) extending therethrough to permit air flow into the laundry compartment 33. The location and orientation of the heating duct 55 and dryer outlet opening 57 is such that the heating duct 55 blows hot drying air through the perforations in the rear drum wall 29 and into the laundry compartment 33. The hot drying air passes through the laundry compartment 33, collecting water vapor (i.e., moisture) from the laundry, and exits towards the front of the drum 18, opposite the rear drum wall 29. This heated air flow therefore helps dry wet laundry in the laundry compartment 33 during a drying cycle.

Additionally, the washer/dryer combination appliance 10 includes at least one exhaust air inlet port 22 and at least one drying air return port 24 on the drum sidewall 25. The exhaust air inlet port 22 and the drying air return port 24 are connected with a condensing system 30 via an exhaust air recirculation loop 59. The condensing system 30 includes a condenser 32 that has a condenser inlet port 34 and a condenser outlet port 36. The exhaust air recirculation loop 59 includes an air inlet conduit 61 that extends between the exhaust air inlet port 22 on the tub 20 and the condenser inlet port 34 of the condenser 32 and an air outlet conduit 63 that extends between the condenser outlet port 36 on the tub 20 and the condenser outlet port 36 of the condenser 32. The air inlet conduit 61 and the exhaust air inlet port 22 are arranged along the tub sidewall 25 and are configured to receive hot exhaust air exiting the drum 18. Meanwhile, the air outlet conduit 63 and the drying air return port 24 are arranged along the tub sidewall 25 between the air inlet conduit 61 and the rear tub wall 57 and are configured to supply drying air exiting the condensing system 30 to the tub cavity 27.

Figure 3:
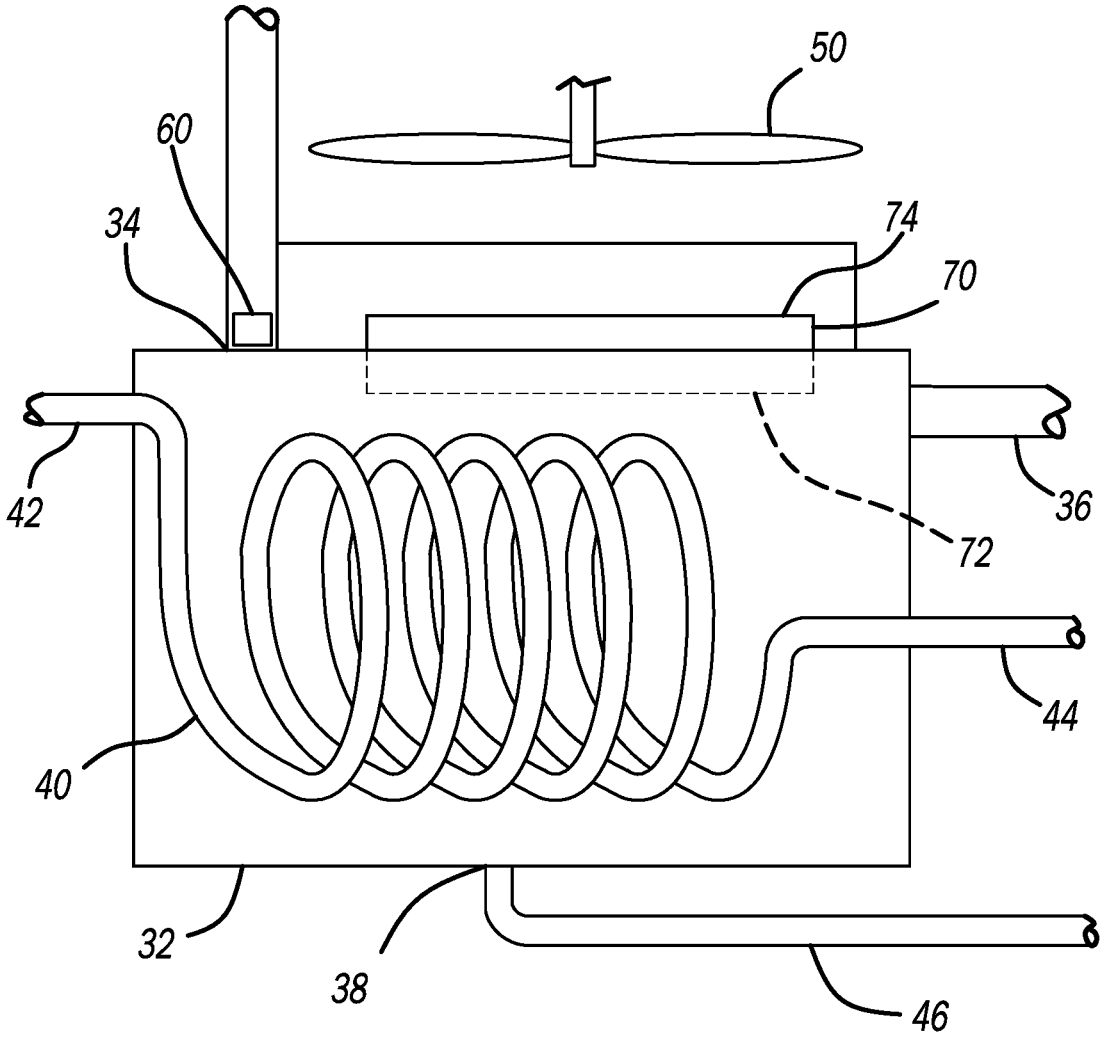
FIG. 3 is an enlarged side cross-sectional view of the exemplary condensing system shown in FIG. 2.

With additional reference to FIG. 3, the condenser 32 includes a condenser coil 40, which preferably is a coiled metal tube that passes through the condenser 32. The condenser coil 40 has a fluid inlet that is connected to a fluid supply line 42 and a fluid outlet that is connected to a fluid return line 44. During a drying cycle of the washer/dryer combination appliance 10, a cooling fluid, such as cold water, is passed through the fluid supply line 42 into the condenser coil 40 and then exits the condenser coil 40 through the fluid return line 44, which is connected to and empties into the common sump 48. As such, the fluid supply line 42 and the fluid return line 44 form part of a condenser coil recirculation loop 65. The water traveling in the condenser coil recirculation loop 65 may be pulsed through the condenser coil 40 to increase residence time while keeping the water in the condenser coil 40 cold, usually at a temperature between 20° C. to 40° C. Water vapor in the hot exhaust air entering the condenser 32 from the tub 20 through the air inlet conduit 61 condenses on the condenser coil 40 and drips into the condenser 32, where this water condensate collects inside the condenser 32. Since cold water from the fluid supply line 42 continues to enter the condenser coil 40 during the operation of the condenser, the condenser coil 40 remains cold and continues to condense water vapor in the hot exhaust air exiting the tub 20 throughout the duration of the drying cycle.

The condenser 32 includes a water condensate outlet 38 that enables the water condensate (i.e., condensed water vapor) to exit the condenser 32. The water condensate is passed from the water condensate outlet 38 of the condenser 32 to the common sump 48 via a condenser drain line 46 that extends between the water condensate outlet 38 and the common sump 48. Thus, the common sump 48 collects the water condensate that is formed and collected in the condenser 32. The water condensate that drains into the common sump 48 has an elevated temperature relative to the temperature of the cooling water passing into the condenser coil 40. Thus, the water condensate cools when it combines with the cooling water and wash water in the common sump 48 and can be re-claimed and recycled into the tub 20 via the wash water dispensing system 37 during a wash cycle. In addition, the fluid in the combined sump 48 can be utilized as a source of cooling fluid for the fluid supply line 42, which supplies cooling fluid (e.g., cold water) to the condenser coil 40. Thus, a recycling of the water condensate as well as the cooling water utilized in the condenser coil 40 can be reused by the combination washing/drying appliance 10 during the washing cycle by the wash water dispensing system 37 and during the drying cycle by the condensing system 30.

The condensing system 30 may further include a fluid transfer conduit 67 that is connected to and extends between the common sump 48 and the fresh water inlet 39. A pump 69 is located in fluid communication with the common sump 48 and the fluid transfer conduit 67. In the illustrated example, the pump 69 is positioned inside the common sump 48, but alternative arrangements where the pump 69 is mounted outside the common sump 48 are also possible. Regardless of the configuration, the pump 69 is configured to pump the fluid, water condensate, and wash water out of the common sump 48 and into the fluid transfer conduit 67.

Although other configurations are possible, in the illustrated example, the water inlet valve 41 is a two-way, T-shaped valve that couples the fresh water inlet 39, the fluid transfer conduit 67, and the water inlet line 43. The water inlet valve 41 is switchable between two open positions (first and second open positions) and a closed position. In the first open position, the water inlet valve 41 permits fluid to flow out of the fluid transfer conduit 67 and into the water inlet line 43, where it may combine with a flow of fresh water from the fresh water inlet 39. This water may then be carried into the tub 20 by the wash water dispensing system 37. In the second open position, the water inlet valve 41 permits the flow of fresh water from the fresh water inlet 39 into the fluid transfer conduit 67. The fluid supply line 42 of the condenser coil recirculation loop 65 is connected to the fluid transfer conduit 67 at junction 71. As a result, the fluid supply line 42 and thus the condenser coil 40 is arranged in fluid communication with and may receive cooling fluid from the common sump 48 and/or the fresh water inlet 39. To this end, the combination washing/drying appliance 10 may include a controller (not shown) in the form of an electronic control unit (ECU) or circuit board that is arranged in electronic communication with the pump 69 and/or the water inlet valve 41. The controller is programmed to control the pump 69 and/or the water inlet valve 41 to supply fluid from the fresh water inlet 39 and/or common sump 48 to the condenser coil 40 in pulses to maintain the condenser coil 40 at a cold temperature as water vapor in the hot exhaust air from the air inlet conduit 61 condenses in the condenser 32. Optionally, the controller may be programmed to turn the pump 69 on and off and/or actuate the water inlet valve 41 based on the temperature of the water in the common sump 48. For example, the controller may turn the pump 69 on and actuate the water inlet valve 41 to the closed position when the water in the common sump 48 is below a temperature threshold that is sufficiently cool to enable efficient operation of the condenser 32. The controller may turn the pump 69 off and actuate the water inlet valve 41 to the second open position when the water in the common sump 48 is above the temperature threshold, such that cold water from the fresh water inlet 39 is supplied to the condenser coil 40. Finally, the controller may turn the pump 69 on and actuate the water inlet valve 41 to the first open position to supply the water from the common sump 48 to the wash water dispensing system 37 during the wash cycle of the combination washing/drying appliance 10.

Optionally, the condensing system 30 may include a fan 50, illustrated schematically in FIGS. 2 and 3, that is positioned inside the appliance housing 12 to blow air over the condenser 32 to reduce the operating temperature of the condenser 32. This further increases the condensing of water vapor in the condenser 32. The condensing system 30 may also include a temperature sensor 60 (e.g., an NTC sensor) that is positioned in the air inlet conduit 61, adjacent to the condenser inlet port 34, where the hot exhaust air enters the condenser 32. The temperature sensor 60 is electrically connected to the controller and measures the temperature of the hot exhaust air entering the condenser 32. The controller uses the temperature measurement information to improve the drying prediction through additional feedback that is provided to algorithmic drying prediction calculations. Also, the temperature sensor 60 helps protect the garments and other laundry in the laundry compartment 33 against excessive heat and also provides a direct temperature measurement of the hot exhaust air to fulfill UL certification. Further, the temperature sensor 60 provides an opportunity for automatic load parameterization that can be used in a smart machine.

A Peltier cell 70 may also be combined with the condenser 32. The Peltier cell 70 is a solid-state active thermoelectric heat pump that transfers heat from a cold side 72 of the Peltier cell 70 to a hot side 74 of the Peltier cell 70. The cold side 72 of the Peltier cell 70 is positioned inside the condenser 32 to increase the production of water condensate therein (i.e., to promote the condensation of the water vapor in the hot exhaust air passing through the condenser 32). The hot side 74 of the Peltier cell 70 may be coupled with the condenser outlet port 36 to reheat the drying air exiting the condenser 32, which is returned to the drum and tub assembly 16, via the air outlet conduit 63 and the drying air return port 24 on the tub sidewall 25. This increases the temperature of the drying air, which has been dehumidified by the condenser 32, before the drying air returns to the drum and tub assembly 16 to help the drying process. Additionally, outside air can be added to the drying air that is passed into the drum and tub assembly 16 through the drying air return port 24. Further, some of the drying air could be vented out of the combination washer/dryer appliance 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A condensing system for a laundry appliance, comprising:

an exhaust air recirculation loop including an air inlet conduit and an air outlet conduit, the air inlet conduit extending between an exhaust air inlet port and a condenser inlet port, the air outlet conduit extending between a condenser outlet port and a drying air return port;

a condenser connected to and arranged in fluid communication with the condenser inlet port of the air inlet conduit and the condenser outlet port of the air outlet conduit, the condenser including a water condensate outlet positioned to drain water condensate collecting in the condenser;

a condenser coil positioned within the condenser, the condenser coil including a fluid inlet and a fluid outlet;

a condenser coil recirculation loop including a fluid supply line connected to the fluid inlet of the condenser coil and a fluid return line connected to the fluid outlet of the condenser coil;

a condenser drain line connected to the water condensate outlet; and a common sump arranged in fluid communication with both the fluid return line and the condenser drain line such that the common sump is configured to collect fluid exiting the condenser coil and the water condensate draining from the condenser, wherein the common sump is arranged in fluid communication with both the fluid supply line of the condenser coil recirculation loop and a fresh water inlet of the laundry appliance such that the common sump is configured to supply the fluid and water condensate returning to the common sump to both the condenser coil and the fresh water inlet for use in a washing cycle of the laundry appliance.

2. The condensing system of claim 1, wherein the fluid and water condensate returning to the common sump is supplied to the fresh water inlet where it combines with fresh water before being used in the washing cycle of the laundry appliance.

3. The condensing system of claim 2, further comprising:

a fluid transfer conduit connected to and extending between the common sump and the fresh water inlet.

4. The condensing system of claim 3, further comprising:

a pump located in fluid communication with the common sump and the fluid transfer conduit, wherein the pump is configured to pump the fluid and water condensate out of the common sump and into the fluid transfer conduit.

5. The condensing system of claim 4, wherein the fresh water inlet includes at least one valve that is arranged to permit fluid flow out of the fluid transfer conduit in a first position and permit the flow of fresh water into the fluid transfer conduit in a second position.

6. The condensing system of claim 5, further comprising:

a controller that is arranged in electronic communication with at least one of the pump and the valve of the fresh water inlet, the controller being programmed to control at least one of the pump and the valve of the fresh water inlet to supply the fluid to the condenser coil in pulses to maintain the condenser coil at a cold temperature as water vapor in hot exhaust air from the air inlet conduit condenses on the condenser coil.

7. The condensing system of claim 4, wherein the fluid supply line of the condenser coil recirculation loop is arranged in fluid communication with at least one of the pump and the fluid transfer conduit.

8. The condensing system of claim 1, further comprising:

a fan positioned to direct cooling airflow over the condenser to further cool the condenser and promote the condensation of water vapor inside the condenser.

9. The condensing system of claim 1, further comprising:

a temperature sensor positioned in the air inlet conduit adjacent to the condenser inlet port to take temperature measurements of hot exhaust air flowing into the condenser.

10. The condensing system of claim 1, further comprising:

a Peltier cell attached to the condenser, the Peltier cell including a cold side arranged to promote the condensation of water vapor within the condenser and a hot side arranged to reheat drying air exiting the condenser through the condenser outlet port.

11. A combination washer/dryer appliance, comprising:

an appliance housing;

an appliance door pivotally mounted to the appliance housing;

a drum and tub assembly positioned inside the appliance housing, the drum and tub assembly including a tub and a drum that is rotatably supported within the tub;

a fresh water inlet disposed within the appliance housing and configured to be connected to a fresh water source;

an exhaust air recirculation loop including an air inlet conduit and an air outlet conduit, the air inlet conduit extending between an exhaust air inlet port and a condenser inlet port, the air outlet conduit extending between a condenser outlet port and a drying air return port;

a condenser connected to and arranged in fluid communication with the condenser inlet port of the air inlet conduit and the condenser outlet port of the air outlet conduit, the condenser including a water condensate outlet positioned to drain water condensate collecting in the condenser;

a condenser coil positioned within the condenser, the condenser coil including a fluid inlet and a fluid outlet;

a condenser coil recirculation loop including a fluid supply line connected to the fluid inlet of the condenser coil and a fluid return line connected to the fluid outlet of the condenser coil;

a condenser drain line connected to the water condensate outlet; and a common sump arranged in fluid communication with both the fluid return line and the condenser drain line such that the common sump is configured to collect fluid exiting the condenser coil and the water condensate draining from the condenser, wherein the common sump is arranged in fluid communication with both the fluid supply line of the condenser coil recirculation loop and the fresh water inlet such that the common sump is configured to supply the fluid and water condensate returning to the common sump to both the condenser coil and the fresh water inlet for use in a washing cycle of the combination washer/dryer appliance.

12. The combination washer/dryer appliance of claim 11, further comprising:

a wash tub drain line connected in fluid communication with and extending between the tub and the common sump, the wash tub drain line configured to receive wash water draining from the tub and carry the wash water to the common sump.

13. The combination washer/dryer appliance of claim 12, further comprising:

a wash water dispensing system connected to the fresh water inlet, the wash water dispensing system is arranged inside the appliance housing and is configured to receive fresh water from the fresh water inlet and dispense wash water into the tub; and a fluid transfer conduit connected in fluid communication with the common sump and the wash water dispensing system, wherein the fluid, water condensate, and wash water returning to the common sump is supplied to the wash water dispensing system for use during the washing cycle of the combination washer/dryer appliance.

14. The combination washer/dryer appliance of claim 13, further comprising:

a pump located in fluid communication with the common sump and the fluid transfer conduit, wherein the pump is configured to pump the fluid, water condensate, and wash water out of the common sump and into the fluid transfer conduit.

15. The combination washer/dryer appliance of claim 14, wherein the fluid supply line of the condenser coil recirculation loop is arranged in fluid communication with the fluid transfer conduit.

16. The combination washer/dryer appliance of claim 11, further comprising:

a heating unit disposed inside the appliance housing, the heating unit including a heater and a dryer duct extending from the heater to a rear wall of the drum, the dryer duct being configured to blow hot drying air through perforations in the rear wall of the drum, wherein the air inlet conduit and the exhaust air inlet port are arranged along a sidewall of the tub and are configured to receive hot exhaust air exiting the drum, wherein the air outlet conduit and the drying air return port are arranged along the sidewall of the tub between the air inlet conduit and a rear wall of the tub and are configured to supply drying air exiting the condenser to the drum.

17. The combination washer/dryer appliance of claim 16, further comprising:

a temperature sensor positioned in the air inlet conduit to take temperature measurements of the hot exhaust air flowing through the air inlet conduit.

18. The combination washer/dryer appliance of claim 16, further comprising:

a Peltier cell attached to the condenser, the Peltier cell including a cold side arranged to promote the condensation of water vapor within the condenser and a hot side arranged to reheat the drying air exiting the condenser through the condenser outlet port.

19. The combination washer/dryer appliance of claim 11, further comprising:

a fan mounted on the tub and positioned to direct cooling airflow over the condenser to further cool the condenser and promote the condensation of water vapor inside the condenser.

20. A combination washer/dryer appliance, comprising:

an appliance housing;

an appliance door pivotally mounted to the appliance housing;

a drum and tub assembly positioned inside the appliance housing, the drum and tub assembly including a tub and a drum that is rotatably supported within the tub;

a wash water dispensing system arranged inside the appliance housing to dispense wash water into the tub;

an exhaust air recirculation loop including an air inlet conduit and an air outlet conduit, the air inlet conduit extending between an exhaust air inlet port and a condenser inlet port, the air outlet conduit extending between a condenser outlet port and a drying air return port;

a condensing system including a condenser connected to and arranged in fluid communication with the condenser inlet port of the air inlet conduit and the condenser outlet port of the air outlet conduit, the condenser including a water condensate outlet positioned to drain water condensate collecting in the condenser;

a condenser coil positioned within the condenser, the condenser coil including a fluid inlet and a fluid outlet;

a condenser coil recirculation loop including a fluid supply line connected to the fluid inlet of the condenser coil and a fluid return line connected to the fluid outlet of the condenser coil;

a condenser drain line connected to the water condensate outlet;

a common sump arranged in fluid communication with both the fluid return line and the condenser drain line such that the common sump is configured to collect fluid exiting the condenser coil and the water condensate draining from the condenser; and a fluid transfer conduit connected in fluid communication with the common sump and both the fluid supply line of the condenser coil and the wash water dispensing system such that the fluid and water condensate returning to the common sump is recirculated to both the condenser coil and the wash water dispensing system for use in a washing cycle of the combination washer/dryer appliance.

* * * * *